US005720320A

United States Patent [19]

Evans

[11] Patent Number: 5,720,320

[45] Date of Patent: Feb. 24, 1998

[54] METHOD AND MACHINE FOR THREE-DIMENSIONAL FABRIC WITH LONGITUDINAL WIRES

[76] Inventor: Rowland G. Evans, 1320 Independence Ave, SE, Washington, D.C. 20003

[21] Appl. No.: 707,671

[22] Filed: Sep. 4, 1996

[51] Int. Cl.[6] ..... D03D 13/00; D03D 25/00; D03D 41/00

[52] U.S. Cl. ..... 139/11; 139/DIG. 1; 139/14

[58] Field of Search ..... 139/14, 11, DIG. 1; 66/11

[56] References Cited

U.S. PATENT DOCUMENTS

| | | | |
|---|---|---|---|
| 3,749,138 | 7/1973 | Rheaume et al. | 139/DIG. 1 |
| 4,492,096 | 1/1985 | Cahuzac | 139/14 |
| 5,137,058 | 8/1992 | Anahara et al. | 139/DIG. 1 |
| 5,224,519 | 7/1993 | Farley | 139/DIG. 1 |
| 5,242,768 | 9/1993 | Nagatsuka et al. | 139/DIG. 1 |
| 5,465,760 | 11/1995 | Mohammed et al. | 139/DIG. 1 |
| 5,540,260 | 7/1996 | Mood | 139/11 |

*Primary Examiner*—Andy Falik

[57] ABSTRACT

A method of producing three-dimensional fabric in flat panels of variable thickness, variable cross sections, wide widths and continuous lengths consisting of stiff wires as the longitudinal fibers and consisting of transverse fibers arranged in a transverse diagonal fabric pattern. A hybrid weaving/knitting machine that is used to produce this fabric by performing the following functions. The rows of longitudinal wires are spread apart vertically to create diagonal yarn corridors between the wires. Knitting needles insert transverse yarns in the diagonal corridors. The spread wires are compressed at the fell of the fabric to the final fabric thickness. The inserted transverse yarns are moved to the fell of the fabric, pulled tight and beat into the completed fabric. The right and left edges of the fabric are bound with the transverse yarns.

2 Claims, 4 Drawing Sheets

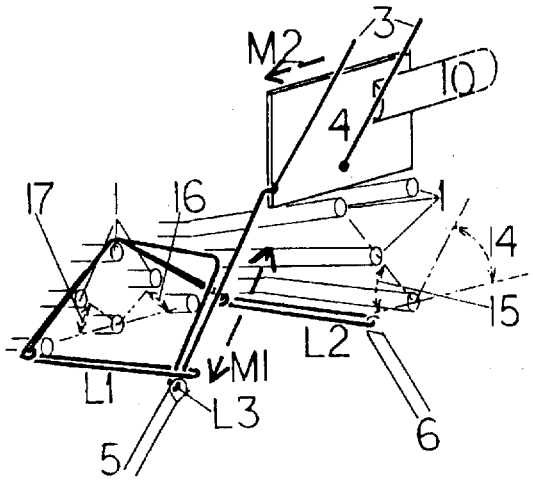
FIGURE 3A
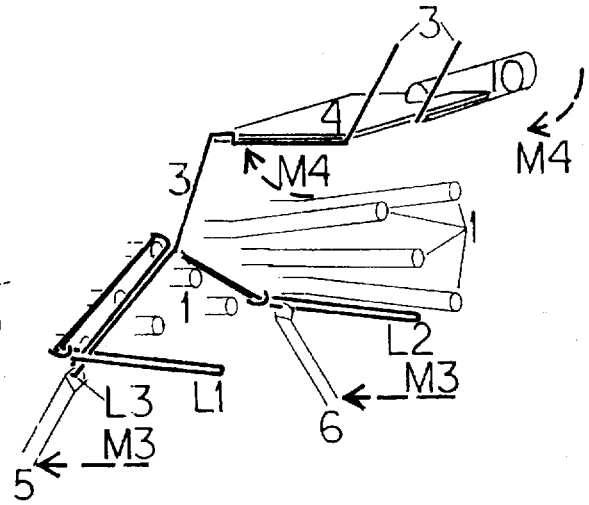
FIGURE 3B
FIGURE 3C
FIGURE 3D
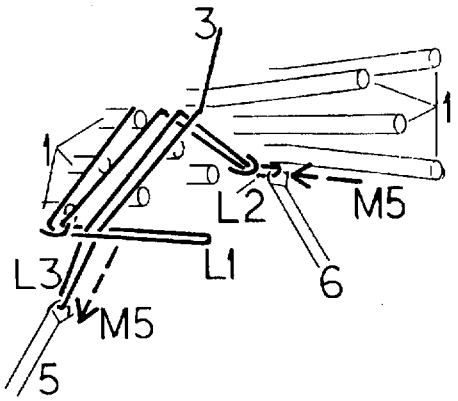
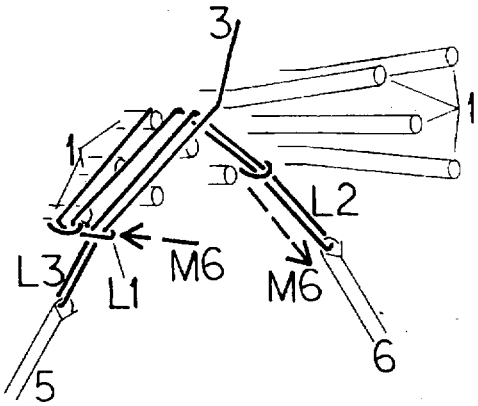
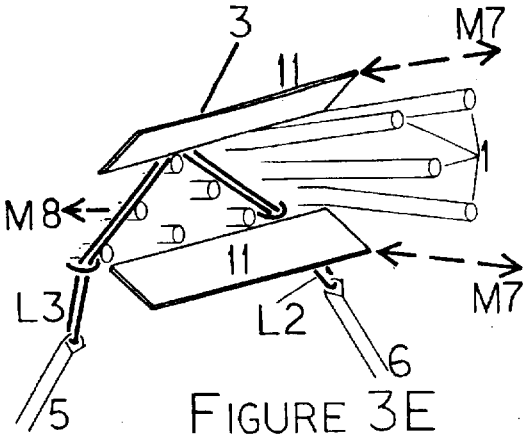
FIGURE 3E
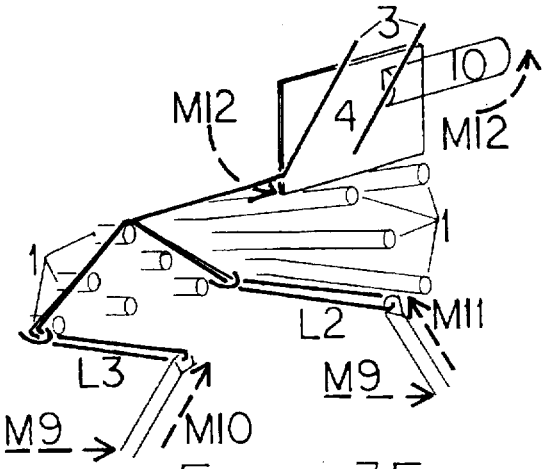
FIGURE 3F

METHOD AND MACHINE FOR THREE-DIMENSIONAL FABRIC WITH LONGITUDINAL WIRES

BACKGROUND OF THE INVENTION

1. Field of Invention

This invention pertains to three-dimensional fabric; specifically to transverse diagonal pattern three-dimensional fabric with stiff wires as the longitudinal fibers in flat panels of continuous length, wide widths, variable thicknesses, and variable cross sections, and to the methods and machines to produce the same.

2. Description of the Prior Art

Three-dimensional fabric structures are primarily useful as the reinforcing material for a range of composite materials in which plastic resins or ceramics are used to impregnate the fabric material which is then molded and cured into composite products having commercially useful properties.

The three basic different fabric manufacturing techniques, e.g. weaving, braiding and knitting, have all been previously used to produce three-dimensional fabric. Each of the implementations has limitations and fundamental differences from this invention.

In the field of weaving, Fukuta, U.S. Pat. No. 3,834,424, disclosed the basic patent for weaving three-dimensional orthogonal fabric. The fabric produced consists of yarns that are straight and orthogonal at 90° in each of the X, Y, and Z axis. U.S. Pat. Nos. 4,526,026 and 5,085,252 disclose enhancements to Fukuta's method and fabric. None of these machines can use stiff monofilament fibers or single strand wires in the fabric. An inherent limitation of these machines is slow weaving speed. Further, the weaving speed is proportionally reduced as fabric width is increased. These machines are also limited in the practical width of fabric that they can produce.

U.S. Pat. Nos. 5,137,058; 5,224,519 and 5,465,760 disclose different methods of inserting paired rows of sheets of bias yarns in the longitudinal plane between the respective rows or sheets of longitudinal yarns in a three-dimensional fabric. In the first of these the bias angles are at +45° and −45° and, in the others, the bias angles can be varied 20°–60°. However, all of the bias angles are in the longitudinal plane for the purpose of improving strength in the bias directions. In all of these, the rows of bias yarns are in addition to the three planes of yarns found in a conventional X, Y, Z three-dimensional fabric which are retained intact as a core part of these bias fabrics. None of these machines can use stiff monofilament fibers or single strand wires in the fabric. These machines are also inherently very slow, the speeds are proportionally reduced as fabric width is increased and they are very limited in the practical width of fabric that they can produce.

U.S. Pat. Nos. 4,031,922; 4,046,173; 4,066,104; 4,140,156 and 4,438,173 disclose different methods for triaxial weaving. Triaxial woven fabric is not a true three-dimensional fabric in that it is a single layer of fabric, not a multilayer fabric. The fabric produced also has the major limitation that the yarns are heavily crimped and are not orthogonal to each other.

U.S. Pat. Nos. 3,749,138; 3,904,464; 3,993,817; 4,001,478; and 4,080,915 disclose methods for weaving hollow cylindrical fabric structures. These machines are not capable of producing flat panels of fabric.

In the field of braiding, Fukuta, U.S. Pat. No. 4,615,256 discloses a method and apparatus for braiding three-dimensional fabric. Although the title of this invention is "woven fabric", this is a misnomer. This is actually a braiding process in which rotating yarn carriers intertwine transverse yarns twisted in the transverse plane around straight longitudinal yarns. This machine is capable of using stiff monofilament fibers or single stand wire as the longitudinal fibers. However, the fabric cross sections are a variety of rectangles and hollow cylinders of limited widths; not wide flat panels. The machine is also inherently slow and the speed is proportionally reduced as fabric width is increased.

In the field of knitting, Banos, U.S. Pat. No. 4,183,232 and Cahuzac, U.S. Pat. No. 4,492,096 invented successively improved methods and machines to knit hollow cylindrical three-dimensional fabric structures. These structures contain straight longitudinal fibers that may consist of stiff monofilament fibers or single strand wires. However, the longitudinal length of these fibers (and the fabric) are not continuous but limited to the height of the knitting machine, e.g. two meters or less. The transverse plane of yarns is inserted in a spiral or helical layer. That is, the knitting needles knit incrementally around the circumference of the cylinder continuously inserting radial (transverse) yarns. They advance in the longitudinal direction by the distance of one layer of radial (transverse) yarn for every revolution of the cylinder past the knitting head. These machines are extremely slow and, of course, cannot produce flat panels of fabric.

However, it is noted that the pattern of Cahuzac's fabric is superficially similar to the transverse diagonal three-dimensional fabric pattern produced by this invention. Cahuzac's fabric has the limitations that it is closed cylindrical form, not flat; the transverse yarns are curved, not straight; loops in the chained loop stitches do not chain with the prior row of knit; and since it is a closed cylinder of fabric without side edges, there is no capability of binding side edges.

In U.S. patent application Ser. No. 08/697,496, "Method, Machine and Fabric Pattern for Transverse Diagonal Three-Dimensional Fabric", Evans describes a machine for producing transverse diagonal pattern three-dimensional fabric in flat panels of continuous length, wide widths and in variable thicknesses and variable cross sections. This method and machine are not capable of using stiff monofilament fibers or single strand wire for the longitudinal fibers. However, the new invention transverse diagonal three-dimensional fabric pattern is very capable of using stiff wires as the longitudinal fibers. This fabric pattern consists of straight longitudinal fibers in the longitudinal plane aligned with the longitudinal axis, straight transverse yarns at +45° and −45° in the transverse plane orthogonal to themselves and the longitudinal fibers, chained loop stitches of transverse yarn at the bottom edge of the fabric, and with right and left side edges bound by transverse yarns. Further, the transverse diagonal fabric pattern facilitates rapid production of this three-dimensional fabric and therefore lower cost. Therefore, this invention will produce fabric in this new transverse diagonal three-dimensional fabric pattern using stiff wires as the longitudinal fibers.

OBJECT AND SUMMARY OF THE INVENTION

The major object of this invention method and machine is to produce three-dimensional fabric in transverse diagonal pattern but with stiff wires as the longitudinal fibers in flat panels, continuous in length in widths of several feet and in variable thicknesses and variable cross sections at speeds at least ten times faster than current machines. Because of the short motions of all components, this invention method is inherently faster, and thus the fabric produced is lower cost, than three-dimensional fabric from weaving looms which are currently the only machines capable of producing flat panels of three-dimensional fabric.

The summary of this invention is to use a new invention machine utilizing a hybrid of weaving and knitting techniques to rapidly produce transverse diagonal three-dimensional fabric which also incorporates unique design features to permit use of stiff wires as the longitudinal fibers. The machine will produce the fabric in flat panels of continuous length, wide widths, variable thicknesses, and variable cross sections.

This invention hybrid weaving/knitting machine consists of the following major components which perform the described functions. First, a wire guide positions each longitudinal fiber in the longitudinal plane in the transverse diagonal pattern and spread sufficiently apart in the vertical dimension so that knitting needles can pass between the wires at steep diagonal angles. Next, a transverse yarn guide, placed above the spread wires, positions each transverse yarn so that it can be caught by a knitting needle. Next, two needle bars, each containing a row of knitting needles mounted at steep angles such as +60° and −60° perform two functions; (a) catching transverse yarns from the yarn guide and drawing them at steep diagonal angles between the spread wires and (b) pulling tight the transverse yarns at +45° and −45° at the fell of the fabric after the fabric has been compressed. A mechanism is required to lock input of transverse yarns while the needle bars pull tight the transverse yarns at +45° and −45°. Compressor rollers are used to compress the spread apart fibers in the vertical dimension to the selected variable thickness and cross section at the fell of the fabric and simultaneously orient the transverse yarns between the longitudinal wires to orthogonal +45° and −45° ready for tightening by the needle bars. Then a beat mechanism is used to compact the transverse yarns into the fell of the fabric. Finally, a needle bar shifter mechanism is required to shift both needle bars longitudinally for their various operations and is also used to shift both needle bars transversely, alternately; one yarn space to the right and to the left which causes transverse yarns to bind the right and left side edges of the fabric.

BRIEF DESCRIPTION OF THE DRAWINGS

FIGS. 3A through 3L show the sequence of actions of the knitting needles, transverse yarn guide, yarn locking mechanism and beat mechanism to weave the transverse yarns around the longitudinal stiff wires. These are isometric views of only one +60° needle and one −60° needle operating on one feed of transverse yarn in one +60° and one −60° needle corridor between their respective longitudinal wires Most of the longitudinal stiff wires are cut-away for clarity. FIGS. 3A and 3L also show the loops of transverse yarns as they are tightened to +45° and −45° at the fell of the completed fabric.

FIG. 3M corresponds to FIG. 3E in the sequence of operation and FIG. 3N corresponds to FIGS. 3K in the sequence of operation.

DETAILED DESCRIPTION OF THE INVENTION

Figure 1:
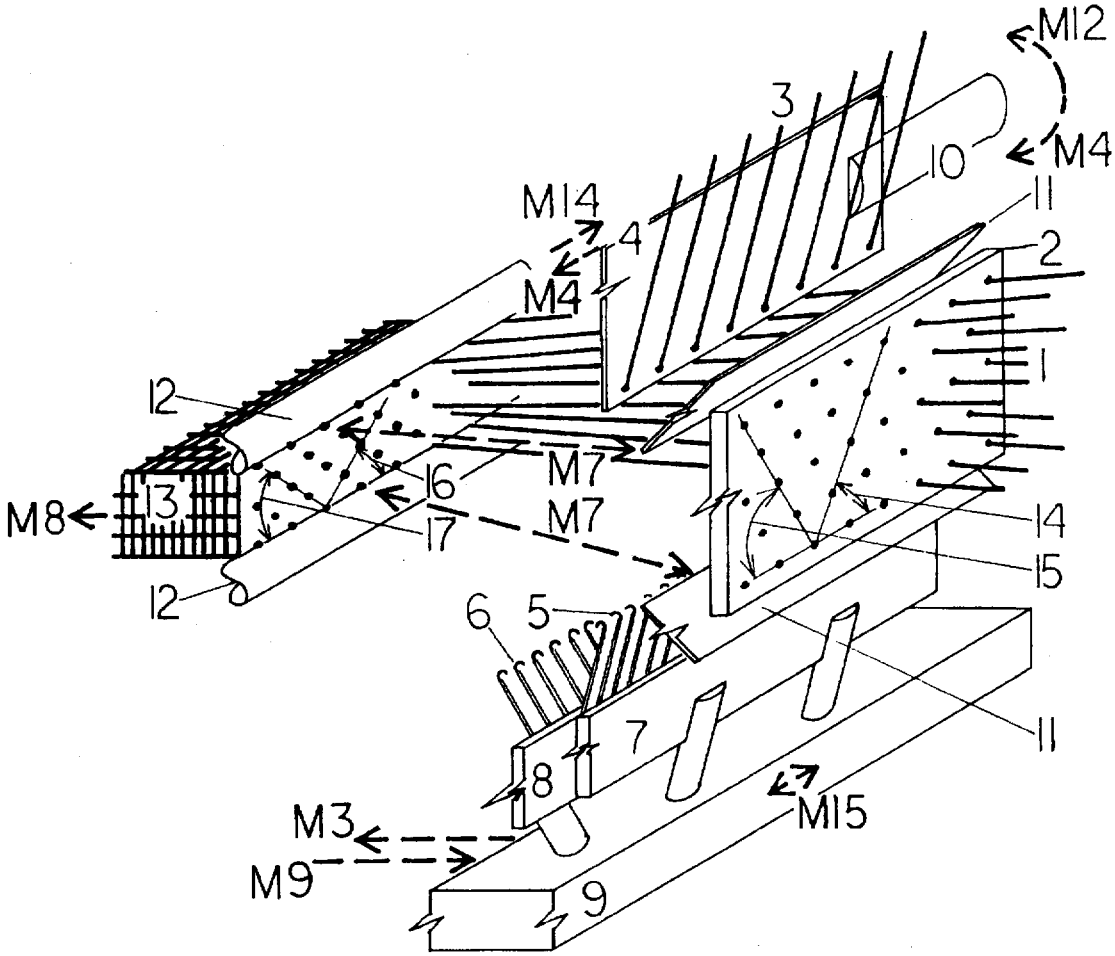
FIG. 1 is a general schematic arrangement of the principal components of the hybrid weaving/knitting machine. It is shown in cut-away and partially exploded perspective for clarity. All motions of the major components except the needle bar assemblies are also shown in this drawing.

This invention method and machine for producing transverse diagonal three-dimensional fabric with longitudinal stiff wires shall now be described.

It should be understood that the terms "up, down, right, left, top, bottom" and so on, shall be used for the sake of clarity and that this invention apparatus may operate in various other orientations.

It should also be understood that the term "yarn" is used only for the sake of clarity to refer to the transverse fibers. This invention specifically includes the capability for this machine to use as transverse fibers yarns (twisted fiber bundles); tows (untwisted fiber bundles); threads (multiple yarns twisted together); and flexible, multistrand fine wires, twisted or not.

This invention specifically includes the capability to utilize a variety of different fiber materials including a mix of different fibers in the same piece of the invention fabric. The different types of fiber material include but are not limited to organic material fibers such as wool, cotton, linen and others; synthetic fibers such as polyester, polyaramid, polypropylene and others; inorganic fibers such as glass, carbon, asbestos and others; and metal wires such as steel, aluminum, alloys and others.

It should be understood the term "stiff wire" is used only for the sake of clarity to refer to the longitudinal fibers of the fabric produced in this invention. Although this machine is technically capable of using any of the above "yarns" as longitudinal fibers, this would not normally be done. Transverse diagonal three-dimensional fabric with longitudinal "yarns" is woven on a much simpler machine not requiring this invention's special design features to weave longitudinal stiff wires. The term "stiff wire" as used in this invention refers to monofilament fibers or single strand metal wires of medium or coarse diameter not capable of bending elastically to sharp angles. That is, the monofilaments either permanently deform or break when bent to a sharp angle. The material composition of "stiff wires" as used in this invention is identical to that described above for non-organic "yarns" The principal difference is that "yarns" utilize multiple strands of very fine filaments of the material, bundled together and usually twisted to produce a "yarn" which is then very flexible and can be bent elastically to very sharp angles. "Yarns" can also be elastically deformed in the diametric or cross section dimension, i.e. "flattened"; stiff wires cannot be elastically flattened. This requires that stiff wires be spread apart before needles can pass between them. Yarns do not need to be spread apart because needles flatten the yarns so they can pass between them.

The Detailed Description of the Invention will be done in two parts; a Description of the Components and a Description of the Sequence of Operation.

DESCRIPTION OF THE COMPONENTS

The first component of this invention machine that will be described is the wire guide 2 shown in FIG. 1. Longitudinal fibers 1 are fed in the longitudinal plane into an array of holes in the wire guide arranged in the diagonal pattern of the fabric. The vertical spacing of the holes is spread apart in the vertical dimension to open clear diagonal needle corridors for the needles to pass between the stiff wires at steep angles such as +60° and −60° from the horizontal 14,15 as shown in FIG. 1 and also in FIG. 3A.

It should be emphasized that needle corridor angles other than +60° and −60° are possible and within the scope of the invention provided that the angles chosen allow sufficient clearance for the needles to pass between the longitudinal fibers.

The diameters and horizontal spacing of the holes in the wire guide must be designed to suit a particular range of wire diameters and wire spacing as desired in the completed fabric. Various of the holes may be left empty to achieve selected width, selected variable thickness and selected variable cross sections in different batches of the fabric. It should be emphasized that other techniques than a perforated plate design for the wire guide are possible and within the scope of the invention including a diagonal cross matrix of wires or reeds.

Figure 3G:
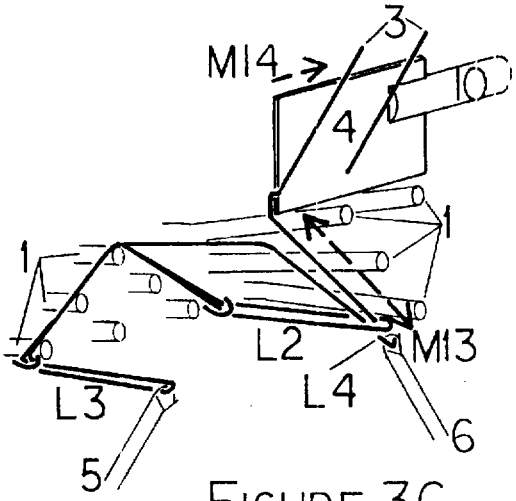

The next element described is the transverse yarn guide 4 shown in FIG. 1 and also in FIGS. 3A, 3B, 3F, 3G, 3H and 3L. Its function is to feed transverse yarns 3 into position above the needle corridors 14,15 as shown in FIGS. 3A and 3F. As the +60° needles 5 or −60° needles 6 reach the top of their stroke, M1,M13 the yarn guide shifts either to the left M2 or right M14 to position a transverse yarn 3 under the hook of each knitting needle. This enables each needle to catch a transverse yarn to be pulled down between the longitudinal wires 1.

Figure 3H:
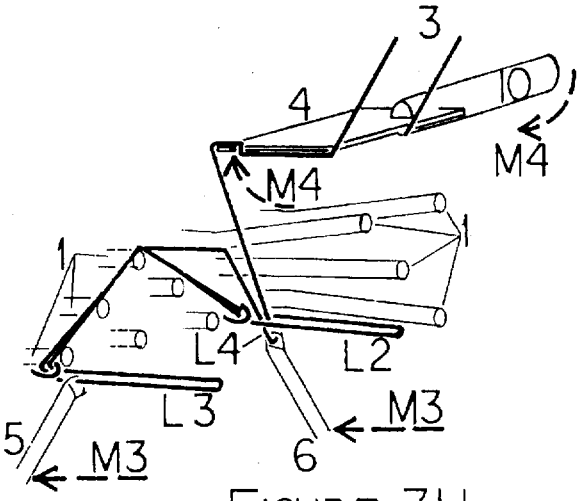

The next elements described are two rows of latch type knitting needles 5,6, mounted in two needle bars 7,8 as shown in FIG. 1. One row of needles 5 is mounted at a steep angle such as +60° in its needle bar and the other row 6 at −60° from the horizontal in its needle bar. These knitting needle assemblies perform two functions: First is insertion of transverse yarns 3 diagonally between the longitudinal wires 1. Each needle bar 7,8 drives its needles 5,6 upward through the longitudinal wires 1 at its 60° angle 14,15, catches a transverse yarn 3 from the transverse yarn guide 4 and pulls the new loop of transverse yarn L3,L4 down between the longitudinal wires 1 as shown in FIGS. 3A and 3G. Second, the needles 5, 6 are used to tighten the transverse yarns at the fell of the fabric. Needles 5 tighten a row of transverse yarns at an angle of +45° to the horizontal show as 16 in FIGS. 1 and 3A and needles 6 tighten another row of transverse yarns at an angle of −45° shown as 17 in FIGS. 1 and 3A. The tightening sequence consists of the needle bars 7, 8 with needles 5,6 successively pulling down M5, M6 the new transverse yarn loops L3, L4 in sequence as shown in FIGS. 3C, 3D, 3I, and 3J. This is done after the input of transverse yarns 3 is locked M4 as shown in FIGS. 3B and 3H. These functions are discussed further under Sequence of Operations.

The maximum thickness of the fabric that can be produced is constrained by the length of the needles. Practical needles can be designed several inches in length which, in turn, can be used to produce fabric several inches thick.

The maximum speed of the machine is constrained by the maximum speed of the needle bars. Since the needles travel only through the thickness of the fabric, needle stroke is inherently short and can be made to operate rapidly.

Figure 3I:
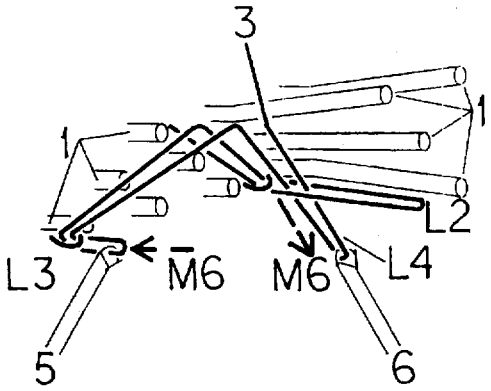
Figure 3J:
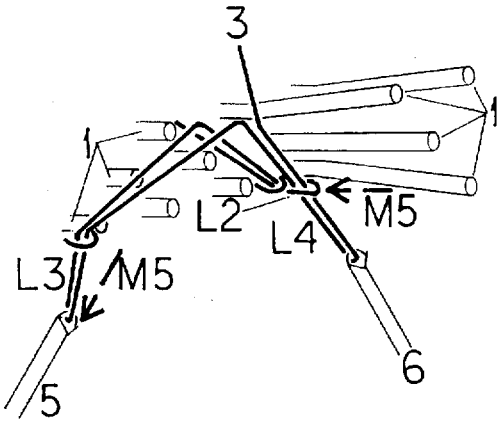
Figure 3K:
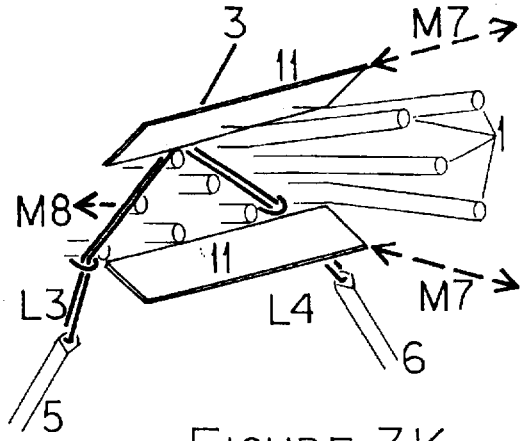
Figure 3L:
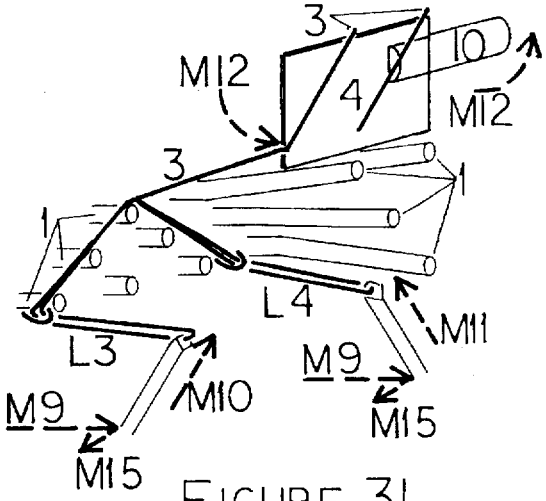

The next component described is the transverse yarn locking mechanism 10 as shown in FIG. 1 and in FIGS. 3A, 3B, 3F, 3G, 3H and 3L. The input of transverse yarns 3 must be locked so that when the needles 5,6 pull down M5,M6 the new transverse yarn loops L3,L4 the needles will pull the transverse yarn loops tight, rather than just pull down more transverse yarn into the needle. The input of transverse yarns is locked by the yarn locking mechanism 10 shown in FIG. 1 that rotates M4 the yarn guide 4 about its transverse axis as shown in FIGS. 3B, and 3H. Rotation M4 of the yarn guide wraps the transverse yarns 3 at sharp angles around both edges of the yarn guide thereby locking them. The yarn locking mechanism 10 also rotates M12 the yarn guide 4 back to its unlocked position after the transverse yarn loops are tightened as shown in FIGS. 3F and 3L.

The next elements described are the compressor rollers 12 shown in FIG. 1. These rollers are located at the fell of the completed fabric. They compress the spread apart longitudinal stiff wires in the vertical direction to the selected variable thickness and selected variable cross section desired in the completed fabric. They simultaneously compress the steep diagonal needle corridors from their steep angles such as +60° 14, and −60° 15 to the final transverse yarn orientation of +45° 16 and −45° 17 at the fell of the fabric as shown in FIG. 1. This is done prior to tightening the transverse yarn loops as discussed further under Sequence of Operations.

The final transverse yarn angles of +45° 16 and −45° 17 are necessary to achieve orthogonal yarn positions within the fabric; no other angle may be used in this invention.

The next component described is the beat mechanism 11 as shown in FIG. 1 and FIGS. 3E and 3K. Two beat reeds 11 are mounted horizontally above and below the longitudinal wires 1. They are moved M7 to compact the new transverse yarn loops L3,L4 against the fell of the fabric, as shown in FIGS. 3E and 3K and then retracted M7. It must be understood that a variety of beat mechanisms are possible and within the scope of the operation.

The next component described is the needle bar shift mechanism 9, shown in FIG. 1. This mechanism holds both needle bar assemblies 7,8 and moves them together, back and forth in the longitudinal axis M3,M9 and in the transverse axis M15. Movement in the longitudinal axis M3,M9 supports the needle bar operations of transverse yarn 3 insertion M1,M13 and transverse yarn loop tightening M5,M6 as described further under Sequence of Operations. Movement in the transverse axis M15 shifts the needle bars 7,8 and the needles 5,6 alternately one yarn space to the right or left as shown in FIG. 3L. This causes the right most knitting needles 5,6 or, alternately the left most knitting needles 5,6 to pull transverse yarn loops L3,L4 outside the right most or left most longitudinal wires 1 on their next stroke, binding these wires to the rest of the fabric as described further under Sequence of Operations.

A variety of take-up mechanisms to pull M8 the completed fabric 13 from the machine of this invention are known to the art which may be used in the practice of this invention. These include but are not limited to rollers, belts or reciprocating clamps.

A variety of actuator mechanisms to actuate the components of this invention are known to the art and may be used in the practice of this invention provided they perform the required actuation. These include but are not limited to pneumatic, electrical and mechanical actuators, mechanical linkages or combinations of these.

A variety of control systems to control the machine of this invention are known to the art which may be used in the practice of this invention. These include but are not limited to manual, electrical, pneumatic, or computer control or combinations of these.

The maximum width of fabric that can be produced is constrained by the designed width of the instant machine.

There are no inherent limits on the width to which this machine can be designed and therefore, practical machines several feet in width can be produced within the scope of this invention. Thus, fabric several feet in width can be produced within the scope of this invention.

The relative positions of the major components as shown in FIG. 1 shall now be discussed.

The longitudinal distance between the wire guide 2 where the stiff wires 1 are spread apart for yarn insertion and the fell of the fabric where the compression rollers 12 compress the completed fabric 13 to its final width must be great enough for the stiff wires to bend elastically as they are compressed together. Thus the distance between the wire guide and the compression rollers is a function of the spreading of the stiff wires (increasing spreading increases distance) and the stiffness of the wires (increasing stiffness increases distance).

The position of the needle bar assemblies 5,6,7,8 for yarn insertion M1,M13 must be immediately below the point where the stiff wires 1 are spread apart which is just to the rear (left) of the wire guide 2 as shown in FIG. 1.

The position of the transverse yarn guide 4 must be immediately above the needles 5,6 when they reach the top of their strokes M1,M13 to facilitate the needles catching the transverse yarns 3 as shown in FIGS. 3A and 3G.

The position of the needle bar assemblies 5,6,7,8 for yarn tightening must be below and just to the front (right) of the compressor rollers 12 as shown in FIG. 1.

Therefore, the needle bar shifter 9 must be located so as to shift M3,M9 the needles 5,6 between their transverse yarn insertion position shown in FIGS. 3A and 3G and their transverse yarn tightening position as shown in FIGS. 3C, 3D, 3I and 3J.

The needle bar shifter 9 must also be located to shift M15 the needles 5,6 one yarn space to right or to left when the needles are in their transverse yarn insertion position as shown in FIG. 3L.

The position of the upper and lower beat mechanisms 11 must allow them to move longitudinally along the upper surface and lower surface respectively of the longitudinal wires 1 to compact transverse yarns 3 into the fell of the fabric at the compression rollers 12.

SEQUENCE OF OPERATIONS

The detailed sequence of operations of the major components of the hybrid knitting/weaving machine that were described above shall now be presented.

Figure 2:
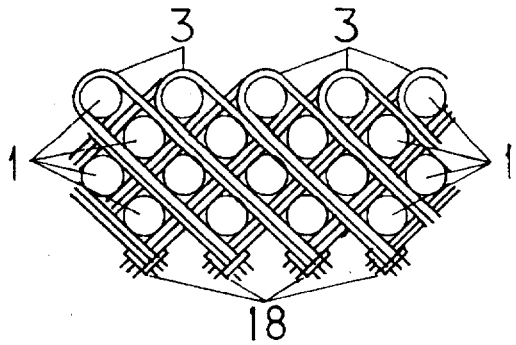
FIG. 2 shows the cross section of the completed transverse diagonal pattern three-dimensional fabric used in this invention.

In FIG. 3A two needles are shown, one needle 5, is representative of the row of +60° needles 5 shown in FIG. 1, and the other 6, is representative of the row of −60° needles 6 also shown in FIG. 1. The representative needles 5,6 are shown in FIG. 3A positioned below the point where the stiff wires 1 have been spread apart creating steep yarn corridors of +60° 14 and −60° 15. The +60° needles 5 stroke upward M1 rising through the old loop L1 of transverse yarn from the preceding insertion. At the top of their stroke the needles 5 catch a transverse yarn 3 held in position by the yarn guide 4. Catching the transverse yarn 3 is facilitated by moving the transverse yarn guide 4 to the left M2. This motion M2 moves a transverse yarn 4 into the hook of a needle 5. The needles S now complete their stroke motion M1 by retracting and pulling a new loop L3 of transverse yarn down through the +60° yarn corridor 14. At the bottom of the stroke, the needle 5 pulls the new loop L3 through the old loop L1 of transverse yarn thus forming a chained loop stitch in which the new loop L3 is chained to the preceding row of transverse yarns by the old loop L1. The chained loop stitches 18 at the bottom edge of the panel of fabric are also shown in FIG. 2.

In FIG. 3B, both rows of needles represented by 5,6 are shown shifted M3 from the transverse yarn insertion position to the transverse yarn tightening position. The transverse yarn tightening position is below the fell of the completed fabric and immediately in front of (to the right of) the compressor rollers 12 as shown in FIG. 1. The needles 5,6 hold yarn loops L3 and L2 during the shift. At the same time, the transverse yarn locking mechanism 10 rotates M4 the transverse yarn guide 4 so that its lower edge is rotated to the rear. This wraps transverse yarns 3 around both edges of the transverse yarn guide 4 at sharp angles, thus locking input of transverse yarns. This action also positions the transverse yarns 3 over the new transverse yarn loop L3 held by the needles 5 at the yarn tightening position at the fell of the fabric.

Now in FIG. 3C, the +60° needles 5 are moved down M5 pulling down the new loop L3 of transverse yarn which tightens M5 the old loop L2.

Next in FIG. 3D, the −60° needles 6 are moved down M6 pulling down the old loop L2 which in turn tightens M6 old loop L1.

In FIG. 3E, the upper and lower beat mechanisms 11 are moved to the rear M7 compacting transverse yarns 3, L2 and L3 into the fell of the fabric. The beat mechanisms then complete their motion M7 and retract. Also shown in FIG. 3E is the motion M8 of the completed fabric 13 as it is taken up from the machine.

In FIG. 3F, both rows of needles 5,6 are shifted M9 from the yarn tightening position back to the yarn insertion position for the next stroke. Both rows of needles 5,6 are moved upward M10,M11 from their pull tight position to the start of stroke position. Also the transverse yarn locking mechanism 10 rotates M12 the transverse yarn guide 4 so that its lower edge moves forward M12. This unlocks the transverse yarns 3 and positions them over the yarn insertion corridors.

In FIG. 3G, the −60° needles 6 stroke upward M13 through the old yarn loops L2. At the top of their stroke, they catch loops of transverse yarn 3 which have been positioned to engage their hooks by the motion M14 of the transverse yarn guide 4 to the right. The needles now complete their motion M13 pulling new loops L4 of transverse yarn 3 down through the corridors between the stiff wires 1 and also through the old loops L2 thus forming chained loop stitches.

In FIG. 3H both rows of needles 5,6 are shifted M3 to the yarn tightening position. The transverse yarn locking mechanism 10 rotates M4 the transverse yarn guide 4 thus locking the transverse yarns 3.

In FIG. 3I, the −60° needles 6 are moved down M6 pulling down the new loop of transverse yarn L4 which tightens M6 old loop L3.

In FIG. 3J, the +60° needles 5 are moved down M5 pulling down old loop L3 which in turn tightens M5 old loop L2.

In FIG. 3K, the beat mechanisms 11 beat and retract M7. The completed fabric 13 is taken up M8.

In FIG. 3L, both rows of needles 5,6 are shifted M9 to the yarn insertion position, and are moved upward M10,M11 to the start of stroke position. The transverse yarn locking mechanism 10 rotates M12 the transverse yarn guide 4, unlocking the transverse yarns 3 and positioning them over the yarn insertion corridors.

Figure 3M:
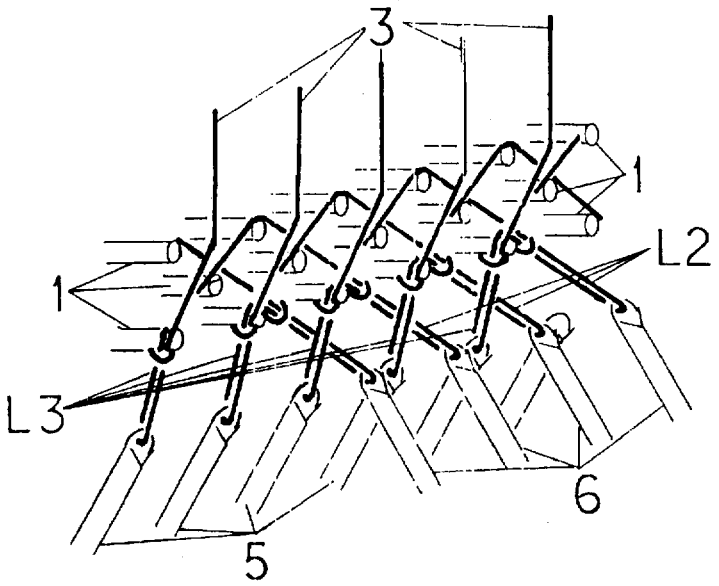
FIGS. 3M and 3N are partial cross sections of the completed fabric showing the arrangement of multiple needles multiple loops of transverse yarn and multiple longitudinal wires.
Figure 3N:
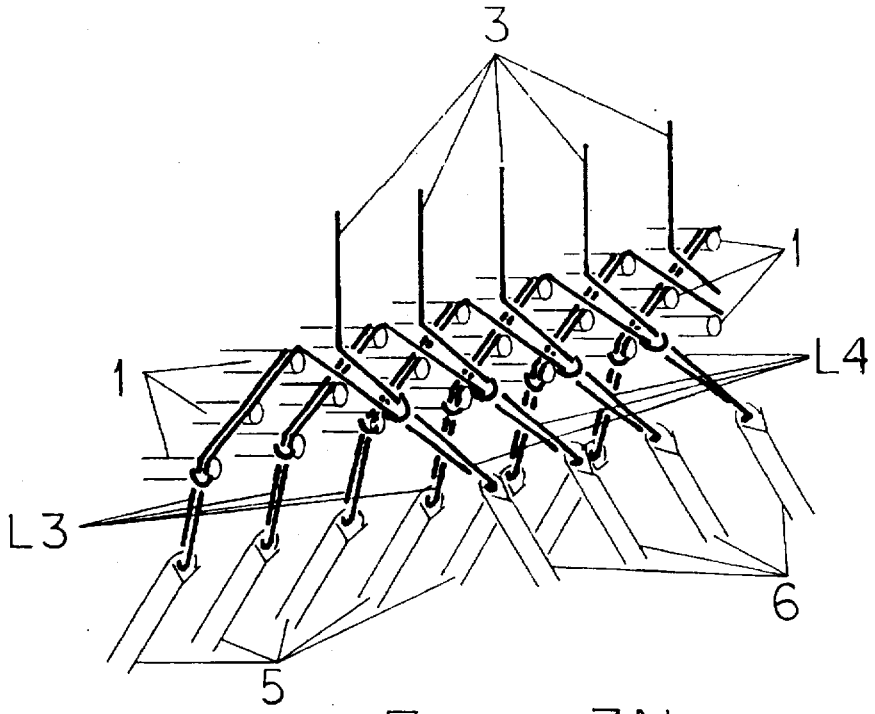

At this time after both a +60° yarn loop L3 and −60° yarn loop L4 insertion M1,M13, tightening M5,M6 and beat up M7 have occurred, the needle bar shifter 9 as shown in FIG. 1, shifts M15 both rows of needles 5,6 alternately one yarn row to the right or to the left as shown in FIG. 3L. When shifted to the left, this will cause the left most needle of the needle rows 5,6 to stroke M1,M13 to the left, outside the left most stiff wires 1 drawing the new loops L3,L4 of transverse yarn 3 around the outside of the left most stiff wires 1 thus binding the left edge wires to the fabric. In like manner, when the needle bar shifter 9 shifts both rows of needles 5,6 to the right M15 the right edge of the fabric will be bound by new loops L3,L4 of transverse yarns 3. In FIGS. 3M and 3N a larger perspective is presented in which a representative row of transverse yarns are shown with multiple needles. FIG. 3M corresponds to the row of transverse yarns inserted in FIGS. 3A–3E. FIG. 3N corresponds to the row of transverse yarns inserted in FIGS. 3G–3K.

I claim:

1. A method for producing wide, flat panels of three-dimensional fabric in continuous lengths, in variable thicknesses and variable cross sections in a transverse diagonal pattern consisting of multiple rows of monofiliment longitudinal fibers or single strand metal wires in the longitudinal plane of the fabric and aligned with the longitudinal axis of the fabric, multiple rows of straight transverse yarns at +45° and −45° in the transverse plane of the fabric orthogonal to themselves and to said longitudinal fibers, chained loop stitches of said transverse yarn at the bottom edge of the panel of fabric, and with right and left side edges of the panel of fabric bound by said transverse yarns; the method comprising the following steps:

(a) feeding said longitudinal fibers in the longitudinal plane of the fabric arranged spread apart in said transverse diagonal pattern to form diagonal yarn corridors between said longitudinal fibers at steep angles sufficient for insertion of said transverse yarns, (b) guiding said transverse yarns into position for insertion between said spread longitudinal fibers, (c) inserting said transverse yarns at said steep diagonal angles in the transverse plane of the fabric between said spread longitudinal fibers, (d) compressing said spread longitudinal fibers to the variable thickness and variable cross section of the fabric and simultaneously orienting said transverse yarns at orthogonal diagonal angles of +45° and −45° in the transverse plane of the fabric, (e) holding said inserted transverse yarns while pulling them tight at +45° and −45° in the transverse plane of the fabric, (f) compacting said transverse yarns to form a completed panel of said fabric, and (g) shifting said transverse yarn insertion alternately one yarn space to the right or left side of the panel of fabric to cause said transverse yarns to bind the right and left edges of the panel of fabric.

2. A machine to implement the method of claim 1 comprising the following components:

(a) a wire guide to feed said longitudinal fibers in the longitudinal plane of said fabric arranged spread apart in said transverse diagonal pattern for insertion of said transverse yarns, (b) a transverse yarn guide to guide said transverse yarns into position for insertion between said longitudinal fibers, (c) two needle bar assemblies each with a row of latch type knitting needles fibers for subsequently tightening said transverse yarns at +45° and −45° in the transverse plane of said fabric polling their insertion, (d) compressor rollers to compress said spread longitudinal fibers to the variable thickness and cross section of said fabric and simultaneously orient said transverse yarns to said orthogonal diagonal angles of +45° and −45° in the traverse plane of said fabric, (e) a transverse yarn locking mechanism to hold said inserted transverse yarns while they are tightened, (f) a beat mechanism for completed said traverse yarns to form a completed panel of said fabric, and (g) a needle bar shift mechanism to shift both needle bars alternately one yarn space to the right or to the left of the said panel of fabric to cause said traverse yarns to bind the right and left side edges of said panel of fabric.

* * * * *